United States Patent [19]

Aiello

[11] Patent Number: 5,056,349

[45] Date of Patent: Oct. 15, 1991

[54] CAN STRAIGHTENING APPARATUS

[76] Inventor: Philip C. Aiello, 1981 Minna Way, San Jose, Calif. 95124

[21] Appl. No.: 607,719

[22] Filed: Nov. 1, 1990

[51] Int. Cl.[5] ..... B21D 1/10

[52] U.S. Cl. ..... 72/302; 413/69

[58] Field of Search ..... 72/302, 301, 295, 367, 72/369; 413/69, 78

[56] References Cited

U.S. PATENT DOCUMENTS

| | | | |
|---|---|---|---|
| 437,702 | 10/1890 | Loomis | 72/302 |
| 2,606,467 | 8/1952 | Desjarlais | 72/302 |
| 2,736,359 | 2/1956 | Bowman | 72/302 |
| 2,855,972 | 10/1958 | Greider . | |
| 3,336,786 | 8/1967 | Norlin . | |

FOREIGN PATENT DOCUMENTS

| | | | |
|---|---|---|---|
| 740699 | 8/1966 | Canada | 413/69 |
| 564049 | 7/1977 | U.S.S.R. | 72/302 |
| 759580 | 10/1956 | United Kingdom | 72/311 |

*Primary Examiner*—Daniel C. Crane

*Attorney, Agent, or Firm*—John J. Leavitt

[57] ABSTRACT

An apparatus for straightening the cylindrical side walls of cans that have been inadvertently bent so as to enable salvage of the food product contained within the can by the application of appropriate labels to the cylindrical side walls of the can includes a base member on which the can is supported with one end of the can anchored so as to prevent its movement in relation to the base member while the opposite end of the can is grasped in appropriate jaws to enable the application of a tensive force to the cylindrical side wall so as to straighten such side walls and eliminate dents formed therein.

8 Claims, 2 Drawing Sheets

CAN STRAIGHTENING APPARATUS

BACKGROUND OF THE INVENTION

1. Field of the Invention.

This invention relates to can straightening devices, and particularly to a can straightening device for straightening full cans of food product after they have been bent.

2. Description of the Prior Art

A preliminary patentability and novelty search in connection with this invention has revealed the existence of U.S. Pat. Nos. 2,736,359; 2,855,972; 3,336,786 and 437,702.

Referring to each of the patents in the order of their issuance, U.S. Pat. No. 437,702 is a very early patent and relates to a structure for stretching helical springs beyond their elastic limit to form a straight bar or rod. Obviously, the device disclosed by this patent has no relevance with regard to the straightening of a bent can full of food product.

U.S. Pat. No. 2,736,359 relates to a device for stretching automobile door panels to restore the door panels to their initial configuration. Again, the structure disclosed by this patent is totally different from the structure disclosed and claimed herein and is used for a totally different purpose.

U.S. Pat. No. 2,855,972 performs the same function as the previous patent, but utilizes a still different structure. In this device, hydraulic fluid is used to expand a device to impose a straightening force on the skin of a door panel being straightened. It is apparent that there is no mechanical or functional correspondence between the teaching of this patent and the invention disclosed and claimed herein.

U.S. Pat. No. 3,336,786 relates to a tool for straightening the spindle of a bicycle fork in relation to the fork portion. This tool permits this to be accomplished without removing the front wheel. Structurally, this device is very different from the invention disclosed and claimed herein, and functions by a different mode to accomplish a different purpose. Accordingly, there is nothing in this patent to suggest the structure disclosed and claimed herein.

In the food industry, particularly in the canning industry, there are two types of containers that are utilized for containing the food products that are canned. One of these is a metal can into which food product is deposited to a predetermined level, which is then caused to pass through a series of retorts where the food product and can containing the food product is subjected to high temperatures to cook the food product, the can subsequently passing into a sealing mechanism for sealing the can after the food product has been cooked. The cans then proceed to the end of a conveyor line where the cans are off-loaded onto pallets, and the pallets then transferred to a warehouse where the cans are stored for subsequent labeling. The contents of the cans are indicated on the lid of the can by indicia which can be numbers, letters or alpha-numeric indicia constituting a code that indicates the contents of the can.

Subsequently, upon receipt of orders to ship a particular food product contained in a can, the cans are selected from the warehouse, pass through a labeling machine that applies a proper label to the can so that prospective customers may see at a glance what the contents of the can are, and the canned food product is then shipped to food distributors or food brokers or ultimate consumers.

The metal containers of food product are sometimes bent to the point that the labels cannot be applied to the cans. The cans are usually not ruptured so as to spoil the contents of the can, but it is impractical to ship the cans if an appropriate label cannot be applied. Cans of food product may be bent in many different ways. Employees may inadvertently drop a pallet of cans, in which case, the cans strike against each other and against other objects, or fall with high impact on a cement floor, or the bending of cans may occur because of catastrophic events such as earthquakes. For instance, in the Oct. 17, 1989 earthquake that occurred in California, many hundreds of thousands of cans of food product of many different types were bent not only in stores where consumers had access to the cans, but also in warehouses before such cans were labeled. Where the bending of the cans occurs after the labels have been applied, it is not too much of an economic burden on the owner of the food product because they may still be sold, albeit generally at a reduced price. However, when the bending of the cans occurs prior to labeling, a different problem is presented because the cans cannot now pass through labeling machines, and even if they do pass labeling stations, the cans can frequently be bent so badly that the labels will not adhere to the non-cylindrical bent surfaces of the cans. Accordingly, it is one of the important objects of the present invention to provide a can straightening apparatus on which sealed full cans of food product may be acted upon in a manner to straighten the cans sufficiently to enable the placement of a label thereon.

Experience has taught that when cans fall or roll about indiscriminately striking other cans and other objects, or when they are tumbled in mass from pallets stacked to great heights of fourteen or fifteen feet, the type of bending that occurs is indiscriminate, each can being bent differently than other cans and some of the cans being bent in several locations about their cylindrical surfaces by the creation of irregular indentations in the cylindrical sides of the can. Accordingly, a still further object of the invention is the provision of an apparatus that will accept such a can having multiple indiscriminate bends in the sidwalls thereof and which by appropriate manipulation will effectively straighten the can sides by eliminating or significantly reducing the indentations to thus permit the application of a label on the can.

When food product packed in cans pass through the high temperature retorts to cook the food product, the food product is heated to a high temperature and air is driven from the inside of the can. Subsequently, the sealing process proceeds while the food product and the can are still very hot. Accordingly, when the sealing has been completed, and the can is permitted to cool, there is a tendency for a slight vacuum to be formed in the sealed can by virtue of the contraction of the hot food product within the can as it cools. When a can containing a slight vacuum such as just described is bent, particularly when it is bent in many different indiscriminate locations about its cylindrical surface, it is frequently necessary to straighten the cylindrical sides of the can by the application of tension on the opposite ends of the can at several locations around its periphery. Accordingly, a further object of this invention is the provision of a can straightening apparatus that may be manipulated to apply such tension on the sides of the can repeatedly in different locations around its circumference.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the can straightening apparatus of the invention comprises a base member on which a bent can of food product may be supported so that access may be had to the perimeter of the bead normally formed at each end of the can by the sealing means thereof. Clamp means are provided at opposite ends of the base member adapted to grasp the beaded end rim of the can at appropriate locations in alignment with a section of the cylindrical surface of the can that is bent inwardly to form a recess, and means are provided for applying tension to such clamp means so as to tension the metal of the can in the region of the indentation, thus causing the metal of the can to pop outwardly and eliminating the recess or indentation. Means are also provided associated with each opposite end of the can to limit axial movement of the can during the straightening operation.

DESCRIPTION OF THE PREFERRED EMBODIMENT

Figures 1, 2, 3, 4:
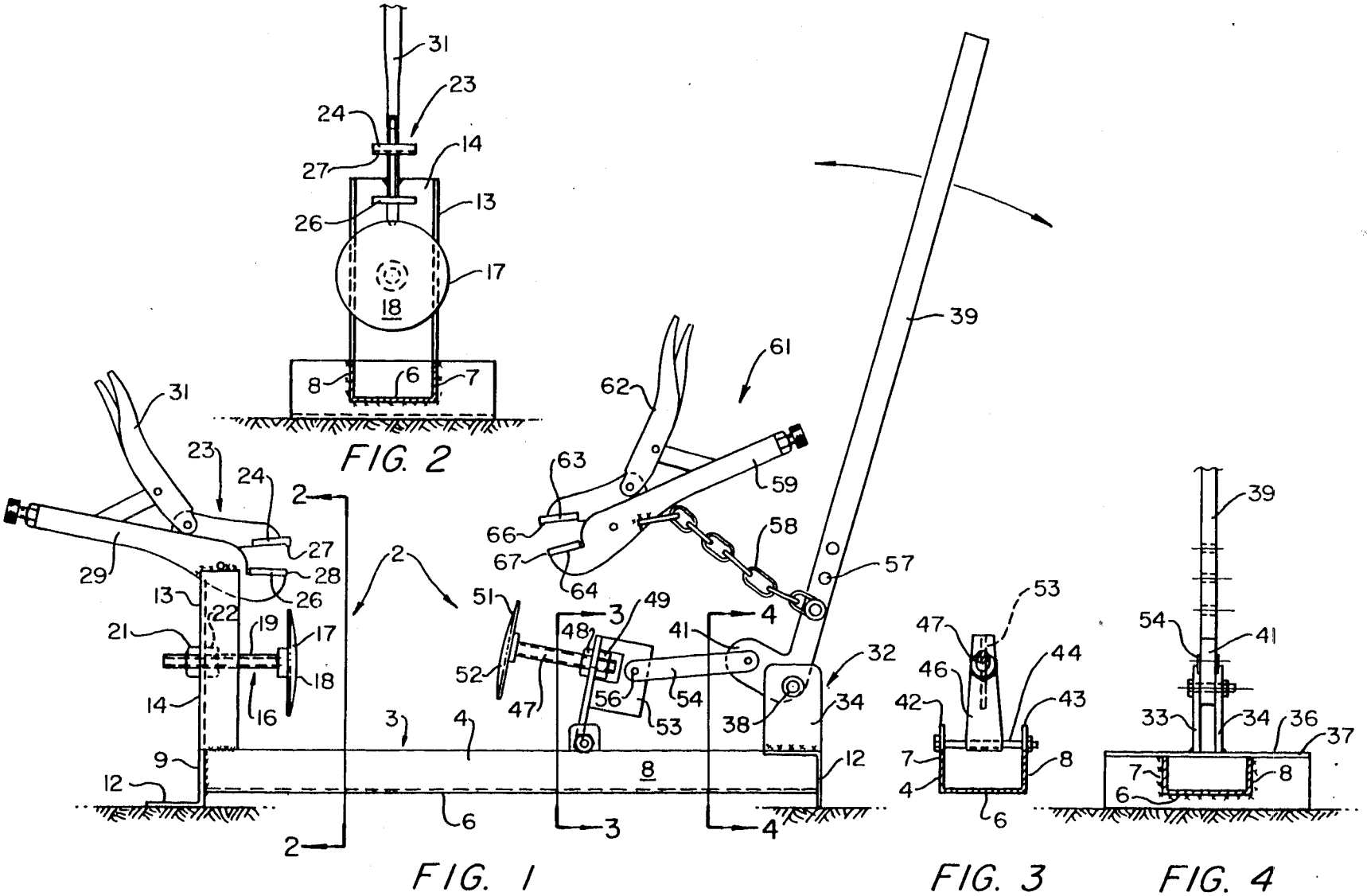
FIG. 1 is a side elevational view illustrating the apparatus of the invention.
FIG. 2 is a vertical cross-sectional view taken in the plane indicated by the line 2—2 in FIG. 1.
FIG. 3 is a vertical cross-sectional view taken in the plane indicated by the line 3—3 in FIG. 1.
FIG. 4 is a vertical cross-sectional view taken in the plane indicated by the line 4—4 in FIG. 1.

In view of the economic loss, or the potential for economic loss to the processors of food products as a result of catastrophic accidents that result in the bending of many hundreds of thousands of tin cans in which food product is stored, it is surprising that no one appears to have developed an apparatus to salvage this product. In general, the method of straightening bent cans described and illustrated herein can be applied to any can of any size containing any food product. However, economics dictates that the method and apparatus be applied to larger cans, for example food product packed in one gallon or larger cans, rather than in the smaller one or two serving size can. Accordingly, the description of this invention will proceed on the basis that the apparatus is utilized to straighten the normally cylindrical but now bent sides of gallon cans in which food product is packed. Accordingly, referring to FIG. 1, it will there be seen that the apparatus forming the subject matter of this invention is designated generally by the numeral 2, and includes a base member 3 conveniently comprising an elongated channel member 4 having a bottom web 6 and side flanges 7 and 8 as illustrated. At opposite ends of the elongated base channel member 4, there is provided angle brackets 9 and 12, a portion of each of which extends below the lower web 6 of the elongated base channel member 4 so that the base member lies elevated above a supporting surface on which the angle brackets 9 and 12 may be supported. It is to be noted that the angle bracket 9 is provided with a horizontal web 12 having appropriate apertures (not shown) through which conventional fastening devices, such as lag bolts or cap screws may be extended to anchor the angle bracket 9 to an appropriate supporting surface such as a table top or work bench.

Mounted on the end of the base 3 associated with the angle bracket 9 is an upwardly extending post designated generally by the numeral 13 and in this instance comprising a relatively short length of channel iron having a web 14 on which is adjustably mounted an abutment assembly designated generally by the numeral 16. The abutment assembly is adjustably mounted on the post 13 substantially medianly between its top and bottom ends, and includes a face plate 17 having a convex surface 18, and a threaded spindle member 19 that is adjustably secured to the web 14 of the channel iron forming the post 13 by appropriate nuts 21 and 22 threaded onto the spindle 19 on opposite sides of the web 14 as shown. Thus, by loosening the nuts 21 and 22, and adjusting their position along the spindle 19, the convex face 18 of the abutment member 17 may be moved toward or away from the post 13 for purposes which will hereinafter be explained.

Figure 5:
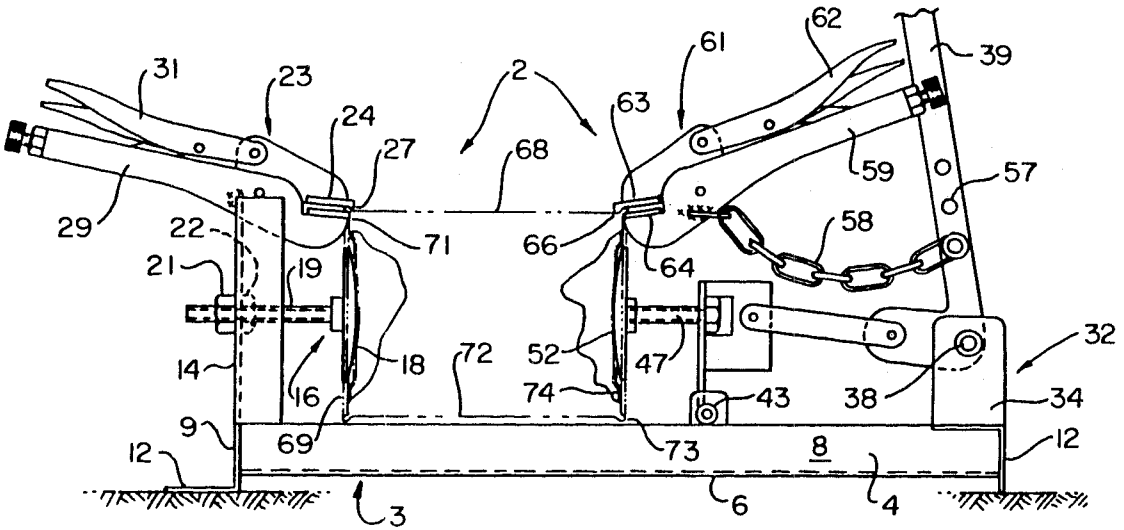
FIG. 5 is a side elevational view illustrating the application of the apparatus to a bent can shown in broken lines.
Figure 6:
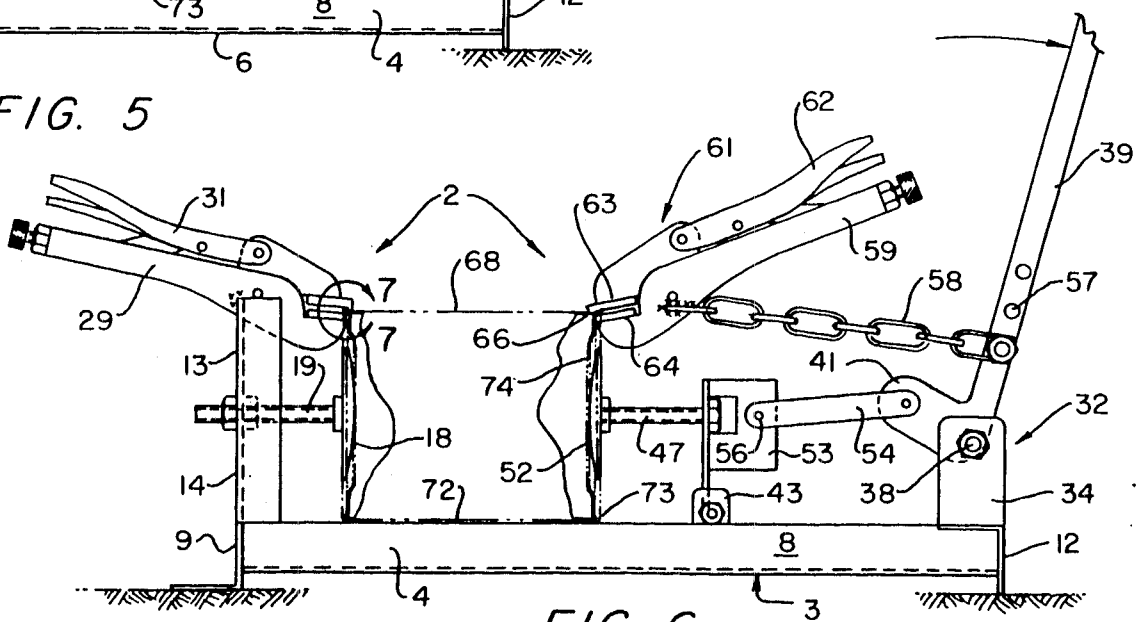
FIG. 6 is a side elevational view similar to FIG. 5 but showing the manner in which tension is applied to the opposed ends of the can which is shown in broken lines.
Figure 7:
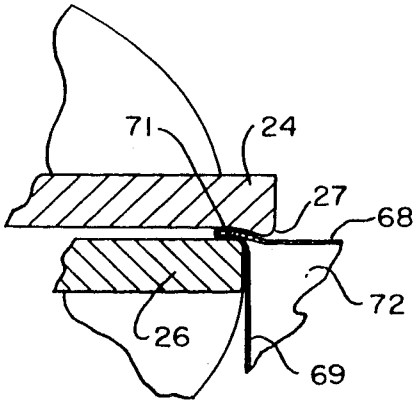
FIG. 7 is a fragmentary sectional view of the area in FIG. 6 indicated by the line 7—7.

Mounted on the top of post 13 is a selectively engageable clamping means designated generally by the numeral 23 and in this instance comprising a pair of adjustable pliers commonly known as "Vice-Grips" with the jaw members 24 and 26 modified to provide a relatively wide surface, the jaw member 24 being provided with a bead or flange 27 which extends beyond the forward edge 28 of the jaw member 26 when the jaws are closed as illustrated in FIGS. 5–7. Closing and opening action of the jaws 24 and 26 is controlled by manipulation of the handle members 29 and 31, the jaw member 26 being fixedly mounted on the handle member 29, while the jaw member 24 is moveably mounted in relation to the jaw member 26 by the handle 31. Those familiar with this type of plier will recognize that when the handle member 31 is moved toward the handle member 29, the jaw member 24 approaches the jaw member 26 and the jaw members are locked together on an object that is disposed between them, or upon themselves, and cannot be released without manipulating the handle 31 away from the handle 29.

Mounted on the other end of the base 3, remote from the angle bracket 9, and associated with the angle bracket 12, is a bifurcated bracket designated generally by the numeral 32 and including side plates 33 and 34 as illustrated in FIG. 4. The bifurcated bracket 32 is preferably welded at its lower end to the top surface 36 of flange 37 of angle member 12, and extends upwardly from the base member to support a pivot pin 38 on which is pivotally journaled a handle 39 having a lateral extension 41 as shown. It should be noted that the lateral extension 41 projects substantially perpendicularly to the handle 39, and that pivotal movement of the handle in the direction of the arrows effects corresponding pivotal movement of the lateral extension 41.

Also mounted on the base member 4 are a pair of spaced lugs 42 and 43 between which is pivoted a pivot pin 44 on which is mounted a lever member 46 that is adapted to pivot in the direction of the long dimension of the base, i.e., toward and away from the abutment surface 18, within limits that will hereinafter be described. Mounted on the lever 46 in adjustable fashion, is a spindle 47 secured by nuts 48 and 49, with an abutment plate 51 having a convex surface 52 mounted on the free end of the spindle 47 as shown. On the back side of the lever 46, i.e., on the side of the lever 46 opposite the abutment member 51, there is mounted a flange 53 to which is pivotally connected one end of a link 54, the other end of which is pivotally mounted to the lateral extension 41 at a point spaced from the pivot pin 38. It will thus be seen that with the handle 39 either in the position illustrated in FIG. 1, or pivoted to its maximum excursion counterclock wise to the left as viewed in FIG. 1, the abutment 51 will be in an elevated position as illustrated, and the horizontal distance between the pivot point 56 that attaches the link 54 to the flange 53 and the pivot 38 will be at its shortest dimension. Conversely, when the handle 39 is pivoted so that the pivot points of the link 54 and the pivot 38 are generally in alignment, as illustrated in FIG. 5, the abutment member 51 will be generally arranged in relation to the base 3 so that the rear surface of the abutment member 51 will be perpendicular to the base 3. Stated another way, when the pivot points of the plate 53, link 54 and pivot 38 are in general alignment, the spindle 47 lies generally parallel and spaced above the long dimension of the base 3. In like manner, in this relationship, the lever 46 is substantially perpendicular, as illustrated in FIG. 5.

Selectively attached to the handle 39 by way of apertures 57 and an appropriate cap screw inserted therethrough is a flexible chain 58, the cap screw fitting through one of the links of the chain as illustrated. The other end of the chain is securely anchored to one handle 59 of a plier designated generally by the numeral 61 and including a second handle 62 that is movable in relation to the handle 59 to open or close the jaws 63 and 64. The jaw members 63 and 64 are modified in that they are extended in width and in length, similar to the jaw members 24 and 26, and the top jaw member 63 is provided with a bead or flange 66 that projects from the face of the jaw member 63, the jaw member 63 being somewhat wider than the jaw member 64 so that when the jaws 63–64 are closed, the bead 66 projects past the forward edge 67 of the jaw member 64.

The structure described above operates in the following manner. With the apparatus in the position illustrated in FIG. 1, a bent can 68 full of food product is layed on its side on channel member 4 with the central axis of the can extending in the same direction as the longitudinal axis of the apparatus. One end lid 69 of the can is placed against the convex abutment surface 18 as illustrated in FIG. 5 and this places the bead 71 formed by the union of the cylindrical side wall 72 with the associated end lid 69 of the can in position to be grasped by the jaw members 24 and 26 as illustrated in FIG. 7. Next, the jaws 63 and 64 of the clamp means at the opposite end of the apparatus are engaged with the bead 73 at that end of the can that corresponds with the bead 71 grasped by the jaws 24 and 26. In this position of the parts, it will be noted that the handle 39 has been pivoted to the left or counterclockwise, there is slack in the tether chain 58, and the extension member 41 has pivoted counterclockwise in order to bring the convex abutment surface 52 of the abutment member 51 into contiguous contact with the associated end of the can. It is important to note that when the cylindrical side wall of a can has been crushed or bent inwardly, it has the effect of bringing the two end lids of the can closer together and these two end lids must in some way be separated to near their original position in order to effect straightening of the cylindrical wall that joins the two end lids. Thus, from the position illustrated in FIG. 5, while the abutment member 51 has pressed forwardly to engage the associated end 74 of the can, initial pivotal movement of the handle 39 in a clockwise direction or to the right as viewed in FIGS. 5 and 6, will initially cause a slight retraction of the abutment member 51, separating it slightly from the associated end lid 74 of the can, so that when the tether chain 58 is tensioned as in FIG. 6, causing the jaw members 63–64 to impose a tensive force on the cylindrical surface of the can that extends between the jaws 63–64 and the jaws 23–24, it will be seen that the abutment member 51 having been retracted a sufficient amount, permits extension of the cylindrical wall and movement of the associated end lid away from the opposing end lid in order to bring the can to substantially its initial dimensions.

It has been found through observation that cans are bent in different ways. Generally, no two cans are bent in the same way. Accordingly, it is very helpful to be able to rotate the can while supported on the base member in order to impose tension on the cylindrical wall along various circumferentially spaced lines about the periphery of the can. To accomplish this purpose, after one cylindrical section of the can has been straightened and restored to near original condition, the plier members are released, the can is rotated to a selected position, the plier members are again engaged with the beads at the ends of the can, and the tensive force is again applied through manipulation of the handle 39. In this way, as many different applications of tensive force may be applied to the cylindrical side walls of the can to effect straightening of the cylindrical wall sufficiently to enable the can to roll in a regular manner through a labeling machine for the application of a label to the now substantially straightened cylindrical side wall of the can.

Having thus described the invention, what is believed to be new and novel and sought to be protected by letters patent of the United States is as follows.

I claim:

1. An apparatus for straightening bent cans normally having spaced parallel opposed end lids joined in first and second spaced beads with a cylindrical side wall symmetrical about a central axis and filled with a food product to enable placement of a label thereon, comprising:

a) an elongated base member having a longitudinal axis for supporting a bent can be straightened so that the central axis of the can extends longitudinally of the base member;

b) first clamp means operatively mounted on one end of said base member and manipulable to detachably grasp a selected portion of said first head at one end of a can supported on said base member;

c) second clamp means operatively mounted on the other end of said base member and manipulable to detachably grasp selected portion of the second bead at the opposite end of the can from said first bead; and d) means operatively associated with said other end of said base member and connected to said second clamp means and manipulable to impose a tensive force on the cylindrical wall of said can in the direction of said central axis to thereby straighten a dented portion of said cylindrical wall;

e) said first and second clamp means comprising plier members manipulable to clamp onto the associated beads at the opposite end of said can, one of said pliers being fixed immovably on said base to retain one end of the associated can immovably thereon while the other plier is movably mounted on the opposite end of said base member whereby movement of said other plier to separate the distance therebetween when said pliers are attached to opposite ends of a can effects imposition of a tensive force on the cylindrical side wall of the can.

2. The apparatus according to claim 1, wherein means are provided on said base member against which the end of said can associated with said first clamp means may abut when a can is supported on said base.

3. The apparatus according to claim 1, wherein means are provided on said base member operatively associated with said second clamp means and forming an abutment against which the associated end of a can supported on said base member may abut when said tensive force is applied to said cylindrical wall.

4. The apparatus according to claim 1, wherein said first clamp means includes a pair of jaws selectively pivotal between open and closed positions, and a flange on one of said jaws adapted to lock behind the associated bead on said can whereby the associated end of the can is precluded from displacement in the direction of said central axis when said tensive force is applied to the opposite end of the can.

5. The apparatus according to claim 4, wherein said second clamp means includes a pair of jaws selectively pivotal between open and closed positions and a flange on one of said jaws adapted to lock behind the associated bead on said can whereby the associated end of the can may be displaced in the direction of said central axis when said tensive force is applied to the cylindrical side wall of the can.

6. An apparatus for straightening bent cans normally having spaced parallel opposed end joined in first and second spaced beads with a cylindrical side wall symmetrical about a central axis and filled with a food product to enable placement of a label thereon, comprising:

a) an elongated base member having a longitudinal axis for supporting a bent can to be straightened so that the central axis of the can extends longitudinally of the base member;

b) first clamp means operatively mounted on one end of said base member and manipulable to detachable grasp a selected portion of said first bead at one end of a can supported on said base member;

c) second clamp means operatively mounted on the other end of said base member and manipulable to detachably grasp a selected portion of the second bead at the opposite end of the can from said first bead; and d) means operatively associated with said other end of said base member and connected to said second clamp means and manipulable to impose a tensive force on the cylindrical wall of said can in the direction of said central axis to thereby straighten a dented portion so a cylindrical wall;

e) said means operatively associated with said other end of said base member and connected to said second clamp means and manipulable to impose a tensive force on the cylindrical wall of said can in the direction of said central axis comprising an elongated handle pivotally mounted on the associated end of the base member, a flexible tether connected at one end to said second clamp means and connected at its opposite end to said handle, whereby pivotal movement of said handle in a direction to tension said tether effects displacement of said second clamp means away from said first clamp means to thereby impose a tensive force on the cylindrical wall of said can in the direction of said central axis.

7. An apparatus for straightening bent cans normally having spaced parallel opposed end lids joined in first and second spaced beads with a cylindrical side wall symmetrical about a central axis and filled with a food product to enable placement of a label thereon, comprising:

a) an elongated base member having a longitudinal axis for supporting a bent can to be straightened so that the central axis of the can extends longitudinally the base member;

b) first clamp means operatively mounted on one end of said base member and manipulable to detachably grasp a selected portion of said first bead at one end of a can supported on said base member c) second clamp means operatively mounted on the other end of said base member and manipulable to detachably grasp a selected portion of the second bead at the opposite end of the can from said first bead;

d) means operatively associated with said the rend of said base member and connected to said second clamp means and manipulable to impose a tensive force on the cylindrical wall of said can in the direction of a central axis to thereby straighten a dented portion of said cylindrical wall;

e) means provided on said base member against which the end of said can associated with sad first clamp means may abut when a can is supported on said base; and f) said abutment means associated with edit first clamp mean being adjustably mounted on said base in relation to said first clamp means to enable accommodation of cans having end plates of different configuration.

8. An apparatus for straightening bent cans normally having spaced parallel opposed end lids joined in first and second spaced beads with a cylindrical side wall symmetrical about a central axis nd filled with a food product to enable placement of a label thereon, comprising:

a) an elongated base member having a longitudinal axis for supporting a bent can to be straightened so that the central axis of the can extends longitudinally of the base member;

b) first clamp means operatively mounted on one end of said base member and manipulable to detachably grasp a selected portion of said firs bead at one end of a can supported on said base member;

c) second clamp means operatively mounted on the other end of said base member and manipulable to detachably grasp a selected portion o the second bead at the opposite end of the can from said first bead;

d) means operatively associated with side other end of said base member and connected to said second clamp means and manipulable to impose a tensive force on the cylindrical wall of said can in the direction of said central axis to thereby straighten a dented portions a cylindrical wall;

e) means on said base member operatively associated with said second clamp means and forming an abutment against which the associated end of a can supported on said base member may abut when said tensive force is applied to said cylindrical wall; and f) said abutment means associated with said second clamp means including linkage means optionally mounted on said base member and operative to alter the position of said abutment means as tensive force is applied to the cylindrical side wall of the can being straightened.

* * * * *